US006176440B1

(12) United States Patent
Elliott

(10) Patent No.: US 6,176,440 B1
(45) Date of Patent: Jan. 23, 2001

(54) WOBBLING SPRINKLER HEAD

(75) Inventor: Frederick T. Elliott, Clermont, FL (US)

(73) Assignee: Senninger Irrigation, Inc., Orlando, FL (US)

( * ) Notice: Under 35 U.S.C. 154(b), the term of this patent shall be extended for 0 days.

(21) Appl. No.: 09/339,658

(22) Filed: Jun. 24, 1999

Related U.S. Application Data

(63) Continuation-in-part of application No. 08/954,238, filed on Oct. 20, 1997, now Pat. No. 5,950,927.

(51) Int. Cl.[7] ..... B05B 3/04
(52) U.S. Cl. ..... 239/222.21
(58) Field of Search ..... 239/222, 222.11, 239/222.17, 222.21, 229, 233, 236, 243, 380, 381, 382, 383, 498, 734, 505, 518, 524

(56) References Cited

U.S. PATENT DOCUMENTS

| | | | |
|---|---|---|---|
| 3,009,648 | 11/1961 | Hait . | |
| 3,034,728 | 5/1962 | Hruby, Jr. . | |
| 3,091,400 | 5/1963 | Aubert . | |
| 4,356,972 | 11/1982 | Vikre . | |
| 4,487,368 | 12/1984 | Clearman . | |
| 4,773,594 | 9/1988 | Clearman . | |
| 4,795,100 * | 1/1989 | Purtell et al. | 239/734 |
| 4,949,905 * | 8/1990 | Jones et al. | 239/279 |
| 5,381,960 | 1/1995 | Sullivan et al. . | |
| 5,950,927 * | 9/1999 | Elliott et al. | 239/222.21 |

* cited by examiner

*Primary Examiner*—Andres Kashnikow
*Assistant Examiner*—Christopher S. Kim
(74) *Attorney, Agent, or Firm*—William M. Hobby, III

(57) ABSTRACT

A wobbling sprinkler head apparatus is provided for use in irrigation systems such as self-propelled mechanically moving irrigation systems, in which the wobbling sprinkler head faces downward from the water supply conduit. The sprinkler head has a body having a water inlet and a connection to the water supply conduit and a nozzle for directing a stream of water from the sprinkler body. The sprinkler head has one or more arms extending from the body around a water deflecting head to support a support collar. The water deflecting head is movably attached to the sprinkler head body and has a water deflecting surface positioned to deflect water directed thereagainst from the nozzle and to rotate the water deflective head. A mass having a weight of greater than 0.5 pounds is removably attached to the support collar to dampen vibrations caused by the wobbling sprinkler head and may be interchanged between different masses to meet different operating conditions.

8 Claims, 2 Drawing Sheets

WOBBLING SPRINKLER HEAD

The present invention relates to a wobbling sprinkler head and especially to a wobbling sprinkler head for use in irrigation systems and the like. This Application is a continuation-in-part of my prior U.S. patent application Ser. No. 08/954,238 filed Oct. 20, 1997, now U.S. Pat. No. 5,950,927, for a Wobbling Sprinkler Head.

BACKGROUND OF THE INVENTION

It has become common practice to use center pivot irrigation systems in the irrigation of large fields and these typically comprise a long water conduit which is pivotally connected at one end to a source of water under pressure. The conduit arm is carried in an elevated position by a plurality of spaced wheels mounted on wheel towers which are powered by hydraulic, pneumatic, or electric motors to rotatably sweep the central conduit over a circular pattern in a field. The center conduit includes a plurality of water sprinkling heads spaced over its length for distributing a spray of water on the circular field area as the center pivot irrigation conduit passes thereby. Center pivot irrigation systems have been successful for uniform distribution of water over a field crop and initially were operated at reasonably high water pressures. Current systems typically work with a somewhat lower water pressure and require that sprinkler heads distribute water evenly as the center pivot irrigation conduit moves through a field. A typical patent for a center pivot irrigation system can be seen in the Vikre patent, U.S. Pat. No. 4,356,972, which mounts the sprinkler heads on top of the central irrigation center pivot conduit. The sprinkler head uses a deflector head for deflecting the water with a grooved deflector pad. Other self-propelled mechanically moving irrigation machines can irrigate in a different manner, such as moving laterally in a straight line through a field.

There have been a number of wobbling sprinkler heads used in the past in which the water distribution head of the sprinkler, instead of being rotated in a smooth rotation or instead of following one of the other sprinkler patterns, has a water distribution head which wobbles in a rotating fashion to provide a more even distribution of water. In the Clearman patents, U.S. Pat. No. 4,487,368 and U.S. Pat. No. 4,773,594, a control pattern wobbling sprinkler is provided in which a rotating sprinkler head has a wobbling water distribution head mounted on the end thereof which has a plurality of vanes formed in the wobbling portion of the head to force a wobbling motion which results from the loose connection between the distribution head and the supporting arm of the sprinkler head. In the sprinkler of these two patents, a base is provided for ground support and a rotating sprinkler head has the end of the rotating arm bent at an angle so that the loosely attached wobbling head tilts groundward when not being used. Upon initiation of water under pressure to the head, the head is already in a cocked position and forces a rotating action which causes a wobbling rotation of the water head portion. In the J. M. Hait patent, U.S. Pat. No. 3,009,648, an irrigation system is provided in which the sprinkler head has a rotating stream of water issuing therefrom but allows a deflection head to move back and forth. In J. O. Hruby, Jr., U.S. Pat. No. 3,034,728, a lawn sprinkler is shown which has a centrally disposed and vertically extending stem which is made to rotate by the action of the water passing through the sprinkler. The stem is loosely mounted and has an uneven deflecting portion to produce a rotating action of the spray. In the M. S. Aubert patent, U.S. Pat. No. 3,091,400, a dishwashing machine has a rotary wobbling spring head which is driven by the water momentum to wobble the head in a dishwasher.

In Applicant's U.S. Pat. No. 5,381,960, a wobbling irrigation sprinkler head includes a magnet for the initial tilt in a wobbling irrigation sprinkler head for use on a self-propelled mechanical moving irrigation system, such as a center pivot field irrigation system, having the wobbling sprinkler head facing downward from the water supply conduit. This sprinkler head produces a wobbling motion as a result of the nozzle directing water onto a deflector pad having a predetermined shape with water deflecting grooves which rotates and wobbles the water deflecting head. A magnet is mounted in the sprinkler head base to attract a ferric metal washer mounted in the wobbling deflecting head to tilt the wobbling water deflector head relative to the base to cock the deflector head to initiate the wobbling in the deflector head.

In Applicant's prior U.S. patent application Ser. No. 08/954,238 for a Wobbling Sprinkler Head, a wobbling irrigation sprinkler head is for use on a self-propelled mechanical moving irrigation system, such as a center pivot field irrigation system, in which the sprinkler heads face downward from the water supply conduit. This sprinkler head produces a wobbling motion as a result of the nozzle directing water onto a deflector pad having a predetermined shape with water deflecting grooves which cause a rotation and wobbling of the water deflecting head. The wobbling motion is produced by a wobble mechanism which has a pair of interacting wobble generating members, one mounted on the water deflection head and the other mounted on the sprinkler body to keep the water deflection head tilted at an angle to the water exiting the water nozzle. The interaction of the protruding members forces the deflection head to start wobbling as the deflection head rotates and maintains the wobble. The water deflection head is blocked from the center axis position to keep the water deflecting surface at an angle to the stream of water being emitted from the nozzle.

One of the problems that occurs with a commercial wobble sprinkler head is the vibration created in the sprinkler head by the wobbling action which can result in wear and premature failure of the sprinkler head. The present invention is a wobbling sprinkler head which reduces the vibration in the sprinkler head. A water deflection head is rotated by a stream of water from a water nozzle. The interaction of a pair of wobble generating members forces the water deflection head to start wobbling as the deflection head rotates. The water deflection head is prevented from the center position by the interacting wobble generating members to keep the water deflecting surface at an angle to the stream of water being emitted from the nozzle. Once the deflection head starts rotating, the protruding members do not touch since the circle of rotation is outside a stationary wobble generating member. A predetermined mass is removably attached to the sprinkler head along the base of the sprinkler head to dampen vibrations in the sprinkler head generated by the wobbling deflector head. The mass is removably attached to allow for the change of the mass depending upon the operating conditions of the sprinkler head.

SUMMARY OF THE INVENTION

A wobbling sprinkler head is provided, especially for use in irrigation systems such as self-propelled mechanically moving irrigation systems, in which the wobbling sprinkler head faces downward from the water supply conduit. The sprinkler head has a body having a water inlet as well as an attachment for connection to the water supply and a nozzle for directing a stream of water from the sprinkler body. The sprinkler head has one or more arms extending from the body around a water deflecting head. The water deflecting head is movably attached to the sprinkler head body and has a water deflecting surface positioned to deflect water directed thereagainst from the nozzle. The water deflecting surface has a predetermined shape including shaped grooves which cause the water deflecting head to move responsive to the water being directed thereagainst. The bottom of the water deflecting surface has a protruding generally bullet shaped member extending therefrom, for interacting with a second protruding member removably attached to a support collar on the end of the arms of the sprinkler head body. The water deflecting head has the one wobble protruding member riding around the second wobble generating protruding member as the water deflecting head rotates responsive to water directed thereagainst from the nozzle. The water deflecting head has a wobbling motion while distributing water from the rotating sprinkler head to thereby vary the sprinkling action. A mass having a weight between about 0.5 and 1.5 pounds is removably attached to the support collar below the second protruding member to dampen vibrations caused by the wobbling sprinkler head and to hold the sprinkler head down under windy conditions and to absorb the initial torque upon starting the sprinkler system.

BRIEF DESCRIPTION OF THE DRAWINGS

Other objects, features, and advantages of the present invention will be apparent from the written description and the drawings in which.

DETAILED DESCRIPTION OF THE PREFERRED EMBODIMENT

Figure 1:
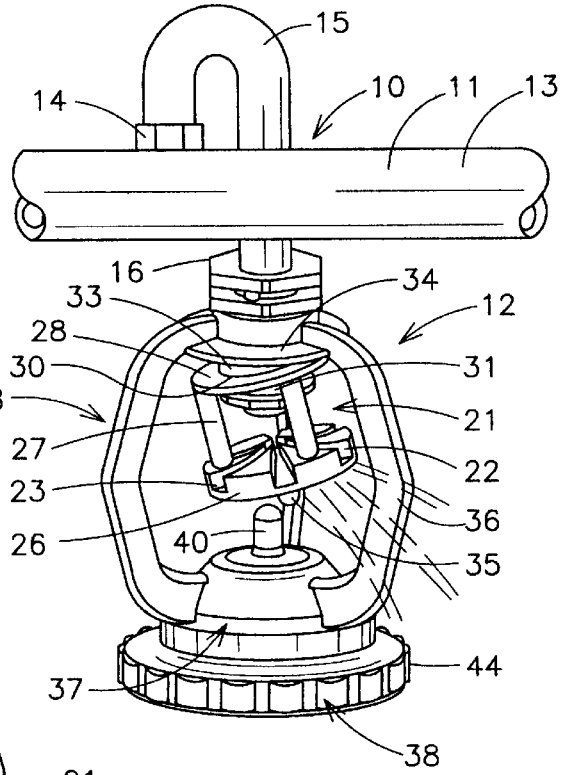
FIG. 1 is a side elevation of a portion of a central pivot irrigation system having the present sprinkler head attached thereto.
Figure 3:
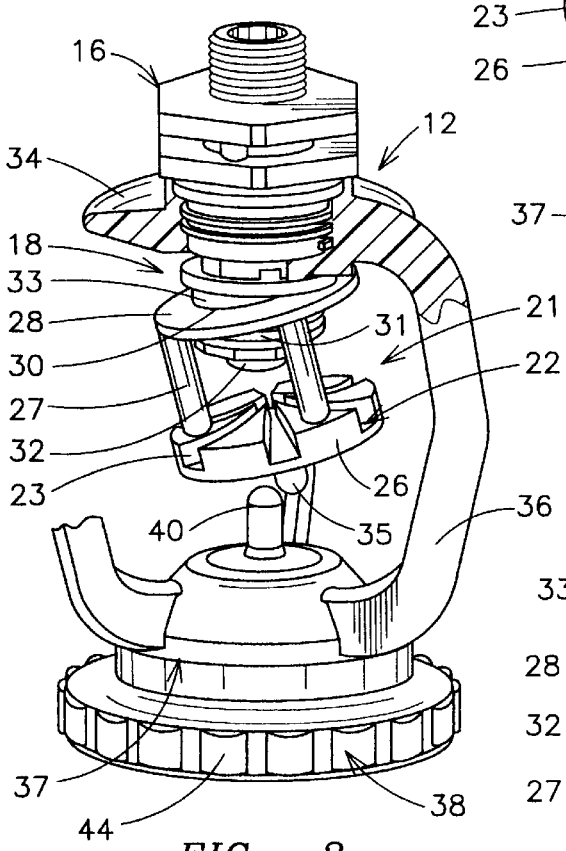
FIG. 3 is a partial perspective view of a sprinkler head in accordance with FIGS. 1 and 2.
Figure 2:
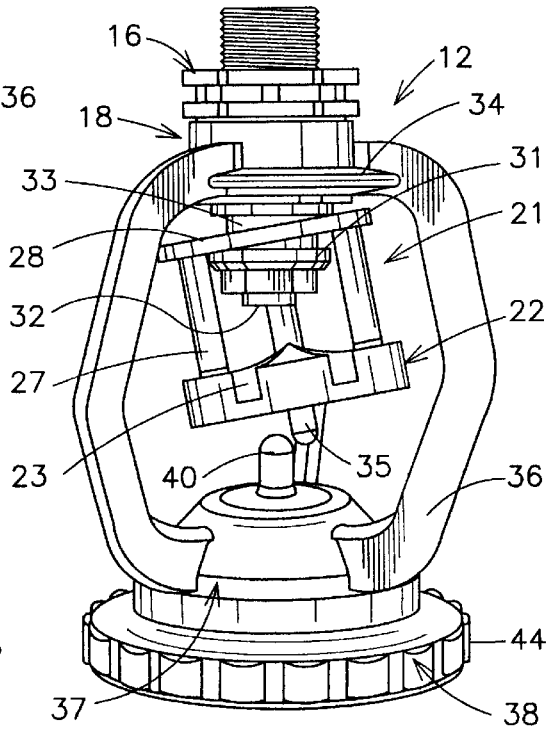
FIG. 2 is a side elevation of the sprinkler head of FIG. 1.

Referring to FIG. 1 of the drawings, a portion of a self-propelled mechanical moving irrigation system, such as a center pivot irrigation system 10, has a central irrigation conduit or water supply pipe 11 which is rotated on wheels in a field, such as in a circular pattern for irrigating the field. The central water supply conduit 11 has a plurality of sprinkler heads 12 attached thereto in a spaced relationship to each other. In this case, each sprinkler head pipe 15 extends from the top 13 of the pipe 11 and includes a pipe coupling 14 attached thereto. The pipe 15 has a U-shaped bend and has the sprinkler head 12 attached thereto.

The sprinkler head 12, as seen in FIGS. 1–4, includes a threaded fitting coupling 16 forming part of the sprinkler head body 18. The body 18 has an attached water deflecting assembly 21 having a water deflecting pad 22 attached thereto. The deflection pad 22 has a plurality of angled grooves 23 formed therein for deflecting water being impinged thereupon in a predetermined pattern with all of the grooves on the deflection pad open along the circular edge portion 26 of the deflection pad 22. The deflection pad is held by a plurality of posts 27. In this case, three posts have been used which are in turn all attached to a post support base portion 28. The post base portion 28 is shaped generally like a washer and may be made of a polymer ring having an opening 30 in the center thereof.

The sprinkler head body 18 has an annular flange 31 which may be a part of the nozzle 32 which is threadedly attached to the body 18. Thus, the water deflection head 21 is supported on the flange 31 around the cylindrical portion 33 beneath the top flange 34. This support of the water deflecting head 21 allows it to rotate on the shaft portion 33 supported by the flange 31 in a loose manner so that when the water exiting the nozzle 32 impinges on the deflection pad 22 not only deflects and rotates the water deflection head 21 but allows it to freely wobble. The water deflection head needs to be set initially in order to start the wobbling action. Deflection pad 22 has a protruding wobble generating member 35 protruding from the bottom of the pad 22. The protruding member 35 can be any protruding shape desired but is shown as a generally cylindrical bullet shaped end.

Figure 4:
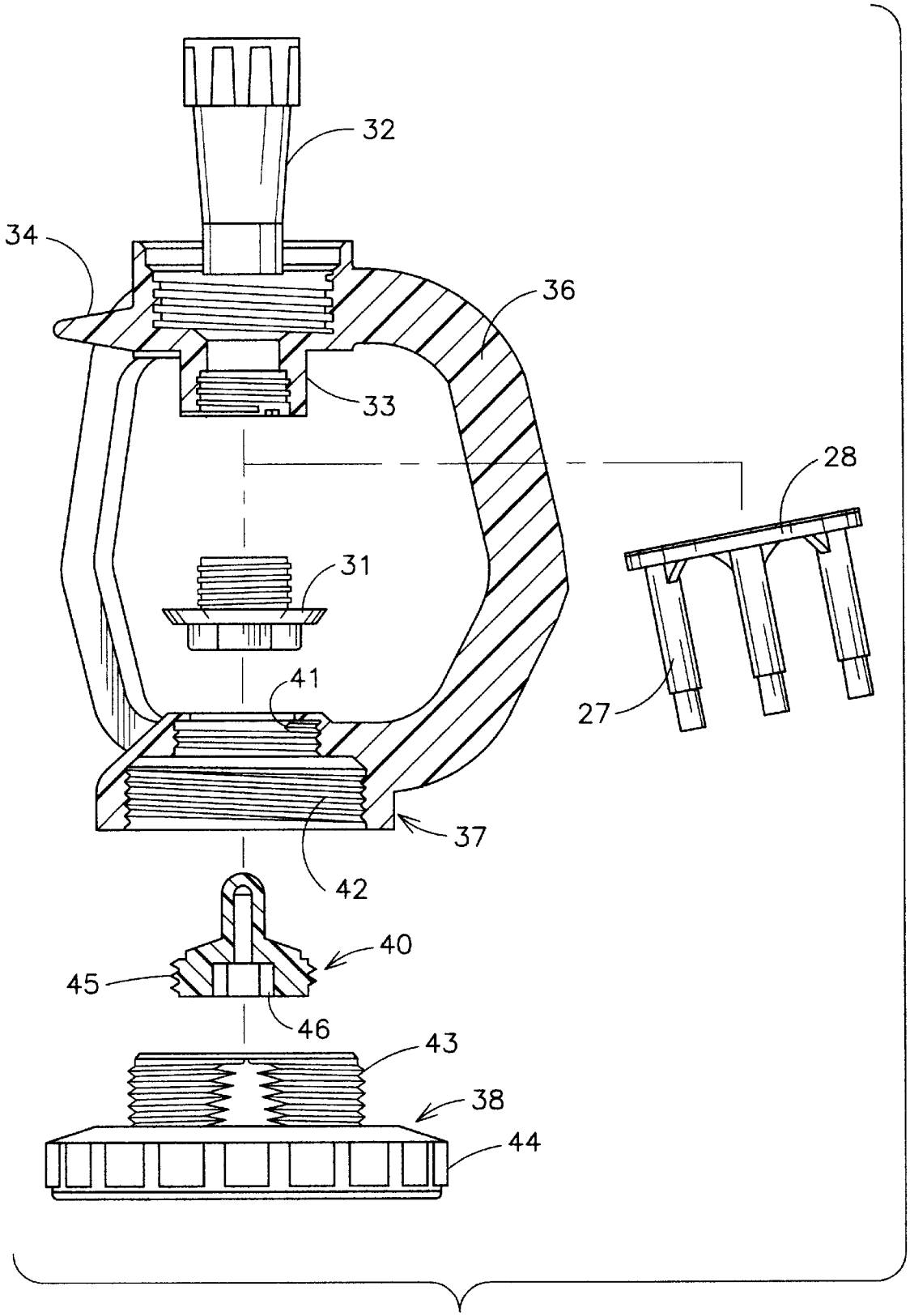
FIG. 4 is an exploded view of the sprinkler head of FIGS. 1 through 3.

The sprinkler head body 18 has a plurality of elongated arms 36 extending therefrom which are attached to a support collar 37 which has a threaded passageway therethrough having first threads 41 and second threads 42. The second wobble producing member 40 as seen in FIG. 4 has an enlarged external threaded base 45 which is threadedly attached to the support collar internal threads 41 to removably support the second wobble producing member 40 in position adjacent the first wobble producing member 35. The mass 38 has external threads 43 which are sized to removably attach the mass to the collar 37 to threads 42. The mass 38 may be made of a zinc alloy or other metal or non-metal and is preferably made in weight sizes of ½ pound, ¾ pound, 1 pound, 1 and ¼ pounds, and 1 and ½ pounds and which may be changed to meet different requirements. The mass 38 has a gripping surface 44 thereon for ease in attaching and removing the mass. The second wobble producing member 40 has a hex insert 46 for attaching the member to the threads 41. This also allows for the easy replacement of the second wobble producing member.

The second wobble producing member is positioned to always maintain the wobble deflecting head off-center. This in turn always maintains the water deflecting head 21 at an angular position, so that as the water which is being emitted from the nozzle 32 onto the grooved water deflection pad 22, forces the deflection pad 22 and the water deflection head 21 to rotate off-center. This will force the entire sprinkler head to wobble as it rotates in a continuously rotating and wobbling motion which continuously changes the water pattern exiting the grooves from the deflection head. The water impinges on the pad 22 of the water deflection head 21 to force the head to rotate by virtue of the pattern of the grooves 23 while the deflection head 21 wobbles. The wobbling and rotating of the deflection head 21 produces a more evenly distributed pattern of irrigation water from the sprinkler head, when being fed by a low pressure central water supply conduit 11 of a central pivot irrigation system or the like. Once the irrigation water has been shut off, the wobbling deflection head 21 will remain at an angled position with the surface of the protrusion member 35 resting against the fixed protrusion member 40 and thus at an angle to the water when the water is first emitted from the nozzle 32. The wobble generating protrusion 35 is in contact with wobble generating member 40 only in the rest position since the circle of rotation of protrusion 35 is outside the stationary wobble generating protrusion 40 so that there is no contact during rotation.

A stabilizing weight or mass 38 is removably attached to allow different weight masses to be attached within the range of 0.5 to 1.5 pounds and to customize each sprinkler head for different degrees of vibration.

The second wobble generating member 40 can be easily replaced as desired. The entire sprinkler head 12 can be made of an injection molded, polymer, except for the mass 38, even though it should be clear that it can be made of any material desired without departing from the spirit and scope of the invention.

It should be clear at this time that the present invention illustrates a wobbling irrigation sprinkler head which can advantageously be attached upside down or extending downward from a self-propelled irrigation water line or other irrigation conduit and which is self-draining and always maintains itself in a position to begin wobbling as soon as the water is turned on to produce a stream of water from the nozzle 32 onto the deflection pad 22 and can absorb vibration caused by the wobbling sprinkler pad and can be easily customized for different amounts of vibration. The added mass also holds the sprinkler head down in windy conditions and absorbs initial torque upon starting the sprinkler system. It also reduces wear points caused by vibrations and thereby reduces maintenance of the sprinklers. However, the present invention should not be construed as limited to the forms shown which are to be considered illustrative rather than restrictive.

I claim:

1. A wobbling sprinkler head comprising:

a sprinkler head body attachable to a water supply and having a water inlet and a nozzle for directing water from said water inlet, said sprinkler head body having a plurality of arms extending therefrom;

a water deflecting head movably attached to said sprinkler head body and having a water deflecting surface positioned to deflect water being emitted from said nozzle, said water deflecting surface having a predetermined shape to cause movement of said water deflecting head responsive to water being directed thereagainst, said water deflecting head having a first protruding wobble generating member extending therefrom; and a supporting collar attached to said plurality of body arms and having a second protruding wobble generating member removably attached thereto and extending therefrom adjacent said water deflecting head and interacting with said water deflecting head first protruding wobble generating member to cause said water deflecting head to wobble responsive to the impact of the water directed thereagainst from said body nozzle;

a stabilizing mass weighing at least 0.5 pounds removably attached to said supporting collar below said second protruding wobble generating member to thereby dampen vibrations in said sprinkler head body whereby vibrations generated by said wobbling water deflecting head are dampened by the mass positioned below the body of the sprinkler head; and attaching means for removably attaching said stabilizing mass to said supporting collar.

2. A wobbling sprinkler head in accordance with claim 1 in which said supporting collar has first internal threads for removably attaching said second wobble generating member and said stabilizing mass includes second external threads for removably attaching said mass to said supporting collar.

3. A wobbling sprinkler head in accordance with claim 1 in which said mass is a metal weight having external threads and a gripping surface for attaching and removing said mass from said supporting collar.

4. A wobbling sprinkler head in accordance with claim 3 in which said second wobble generating member has a hex head insert therein for removably attaching said second wobble generating member to said support collar.

5. A wobbling sprinkler head in accordance with claim 4 in which said water deflecting head water deflecting surface is a grooved deflector head pad.

6. A wobbling sprinkler head in accordance with claim 5 in which said grooved deflector head pad has grooved channels formed therein and shaped to rotate said deflector head when water is impinged thereagainst.

7. A wobbling sprinkler head in accordance with claim 6 in which said stabilizing mass is a zinc alloy.

8. A wobbling sprinkler head in accordance with claim 6 in said supporting collar has a larger threaded opening extending from one side thereof and a smaller threaded opening extending from the other side thereof.

* * * * *